US007926967B2

(12) United States Patent
Spartano et al.

(10) Patent No.: US 7,926,967 B2
(45) Date of Patent: Apr. 19, 2011

(54) HEADLIGHT DEVICES AND METHODS

(75) Inventors: David A. Spartano, Brunswick, OH (US); Thomas I. Meyers, Cayuga, NY (US); David J. Hine, Skaneateles, NY (US); Scott W. Osiecki, Skaneateles, NY (US); Mark A. Ferguson, Memphis, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 12/506,471

(22) Filed: Jul. 21, 2009

(65) Prior Publication Data

US 2009/0323317 A1 Dec. 31, 2009

Related U.S. Application Data

(63) Continuation of application No. PCT/US2008/051774, filed on Jan. 23, 2008.

(60) Provisional application No. 60/881,898, filed on Jan. 23, 2007.

(51) Int. Cl.
*F21V 21/084* (2006.01)

(52) U.S. Cl. ..... 362/105; 362/277; 362/319; 362/103

(58) Field of Classification Search ..... 362/277, 362/319, 800, 103, 105, 106
See application file for complete search history.

(56) References Cited

U.S. PATENT DOCUMENTS

| | | | | |
|---|---|---|---|---|
| 2,309,104 | A * | 1/1943 | Dircksen et al. | 362/277 |
| 4,794,496 | A | 12/1988 | Lanes et al. | |
| 5,115,382 | A * | 5/1992 | Smith | 362/105 |
| 5,558,428 | A * | 9/1996 | Lehrer et al. | 362/105 |
| 5,800,042 | A | 9/1998 | Blank | |
| 6,877,875 | B2 * | 4/2005 | Yu et al. | 362/105 |
| 7,148,632 | B2 * | 12/2006 | Berman et al. | 315/189 |
| 7,192,165 | B2 * | 3/2007 | Petzl et al. | 362/319 |
| 7,261,438 | B2 * | 8/2007 | Alessio | 362/268 |
| 7,568,812 | B1 * | 8/2009 | Kumthampinij et al. | 362/105 |
| 2002/0034073 | A1 | 3/2002 | Halasz | |
| 2003/0021109 | A1 * | 1/2003 | Matthews et al. | 362/202 |
| 2003/0067769 | A1 | 4/2003 | Gilpin | |
| 2003/0117799 | A1 | 6/2003 | Shiu | |
| 2006/0056175 | A1 | 3/2006 | Petzl et al. | |
| 2008/0205036 | A1 * | 8/2008 | Tarter et al. | 362/105 |
| 2008/0316734 | A1 * | 12/2008 | Spartano et al. | 362/105 |

FOREIGN PATENT DOCUMENTS

FR 2828726 A 2/2003

OTHER PUBLICATIONS

Patent Cooperation Treaty (PCT), International Search Report and Written Opinion for Application No. PCT/US2008/051774, filed on Jan. 23, 2008, mailed Jun. 20, 2008, European Patent Office, Netherlands.

XP007904925, Petzl, Retrieved from the Internet on Jun. 10, 2008: http://fr.petzl.com/produitsservices/e86p_tikkaxp_e86504-f_w.pdf.

* cited by examiner

*Primary Examiner* — Anabel M Ton
(74) *Attorney, Agent, or Firm* — Gregory J. Adams

(57) ABSTRACT

A lighting device includes a head assembly, a battery pack, and a light housing. The light housing includes at least one light source and a diffuser lens. The diffuser lens is pivotably coupled to the light housing. The diffuser lens is configured to pivot between a first position in which the diffuser lens diffuses light emitted by the at least one light source and a second position in which a substantial amount of the light emitted by the at least one light source is not diffused by the diffuser lens.

21 Claims, 11 Drawing Sheets

HEADLIGHT DEVICES AND METHODS

FIELD OF THE INVENTION

The present invention relates generally to lighting devices and, more particularly, to wearable lighting devices.

BACKGROUND OF THE INVENTION

Generally, conventional flashlights include a housing, batteries disposed in the housing, a bulb holder, a bulb, and a single switch. The switch, is typically located on the outer circumference of the housing and can be activated to alternatively turn the flashlight on and off. The bulb holder typically includes a spring that is biased against the batteries in the housing as the lamp holder is screwed onto the housing. The spring also serves as an electrical contact for powering a lamp in the lamp holder.

Such conventional flashlights typically require a user to hold and direct the flashlight as needed with his or her hands. This can limit activities of a user because they are required to handle the flashlight and may be unable to use one or both hands.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

A lighting device includes a head assembly, a battery pack, and a light housing. The light housing includes at least one light source and a diffuser lens. The diffuser lens is pivotably coupled to the light housing. The diffuser lens is configured to pivot between a first position in which the diffuser lens diffuses light emitted by the at least one light source and a second position in which a substantial amount of the light emitted by the at least one light source is not diffused by the diffuser lens.

A method for selectively diffusing light emitted from at least one light source in a light housing of a human wearable headlight via a diffuser lens includes selectively pivoting the diffuser lens, which is pivotably coupled to the light housing, to one a plurality of different positions in which the diffuser lens diffuses the light emitted by the at least one light source based on the position of the diffuser lens.

Other devices and methods are also disclosed.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

The present invention will now be described with respect to the accompanying drawings in which like numbered elements represent like parts. The figures provided herewith and the accompanying description of the figures are merely provided for illustrative purposes. One of ordinary skill in the art should realize, based on the instant description, other implementations and methods for fabricating the devices and structures illustrated in the figures and in the following description.

FIGS. 1 to 9 are diagrams illustrating a lighting device 100 in accordance with an embodiment of the invention. The lighting device 100 can be worn on a users head or helmet to facilitate hands free operation.

Figure 1:
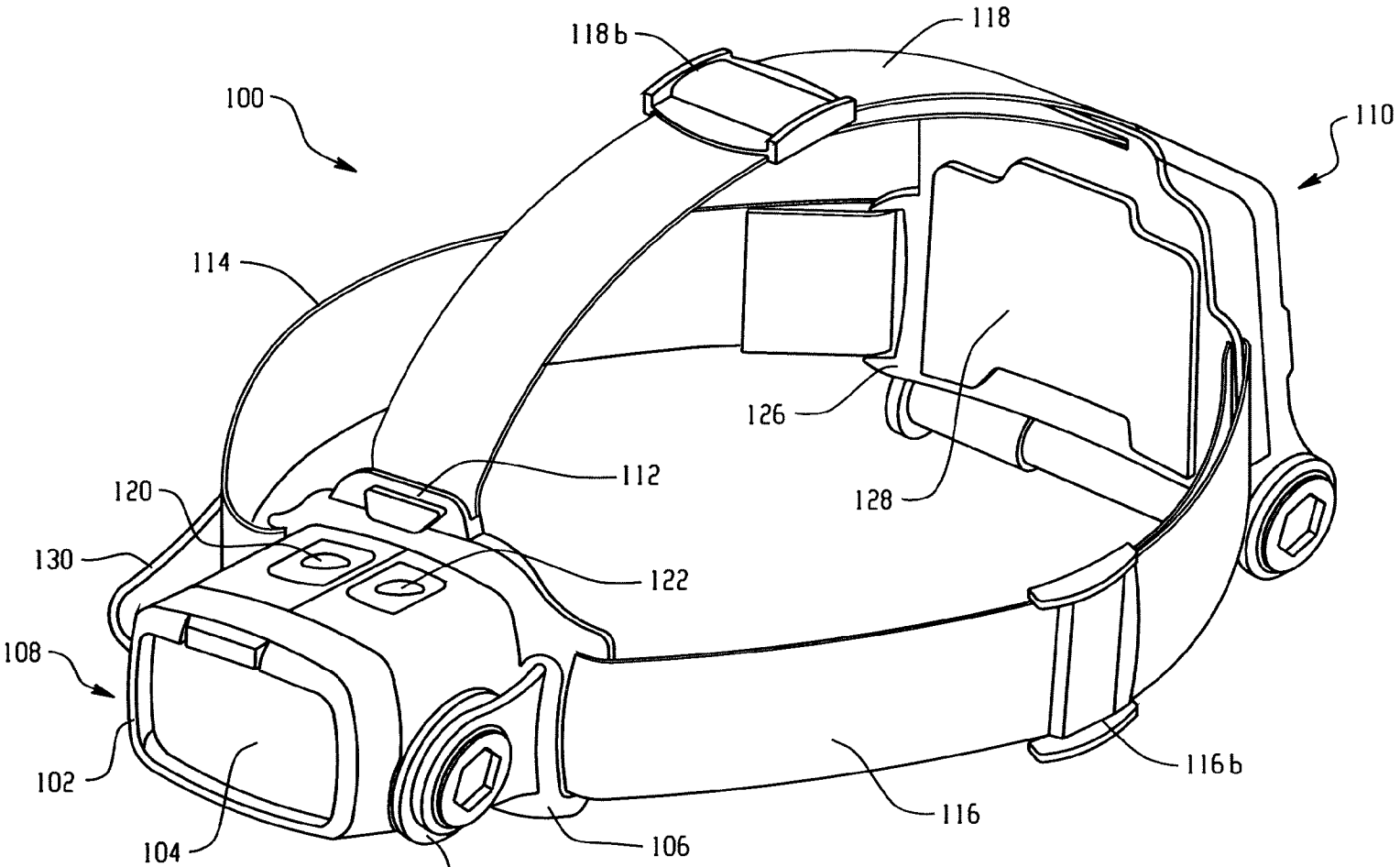
FIG. 1 is a perspective view of the lighting device in accordance with an embodiment of the invention.

FIG. 1 is a perspective view of the lighting device 100 in accordance with an embodiment of the invention. The lighting device 100 includes a light housing 108, a head assembly 106, left strap 116, right strap 114, top strap 118, and a battery pack 110.

The light housing 108 houses one or more light sources and includes a lens ring or bezel 102, a diffuser lens 104, a first mode switch 120, and a second mode switch 122. The diffuser lens 104 is pivotable about a lower portion of the lens ring 102 to operate as an area light in a closed or diffused position and a flood type light in an opened or non-diffused position. The diffuser lens 104 is comprised of a translucent that scatters/diffuses light passing there through. The diffuser lens 104 is positionable throughout a range of open positions to permit degrees of diffusion.

The light housing 108 and the battery pack 110 can be hermetically sealed to mitigate or prevent external gases from entering the housing 108 and/or pack 110.

The first mode switch 120 selects one or more first modes of operation. In one example, the first mode switch 120 comprises a pushbutton for selecting high intensity white light, low intensity white light, and/or off modes of operation. The second mode switch 122 selects one or more second modes of operation. In one example, the second mode switch 122 comprises a pushbutton for selecting a red light, green light, and/or off modes of operation.

The light housing 108 is attached to the head assembly 106 by a pair of pivot housings 124. The light housing 108 can be directed in one or more directions via the pivot housings 124. One of the pivot housings 124 includes a grommet or similar mechanism that provides access to the light housing. Additionally, the pivot housings 124 include detents or other mechanisms (not shown) to partially fix the light housing 108 at various orientations with respect to the head assembly 106. The head assembly 106 also includes a strap release 112 that permits attachment and/or removal of the top strap 118 from the head assembly. A cushion material (not shown) can be affixed to a rear portion of the head assembly 106.

The battery pack 110 generally provides power to the light housing 108 via a conductor wire 130. The battery pack 110 includes a head plate 126 onto which is affixed a battery pack cushion 128. A battery pack case 132, shown in FIG. 3, includes a battery cavity and is affixed to an opposite side or outward facing side of the head plate 126. The battery pack 110 can be configured to weigh an amount about equal that of the light housing 108 to facilitate weight distribution and/or wear of the device 100. Additionally, the battery pack 110 can be comprised of relatively light components to mitigate weight of the device 100.

The left strap 116 is coupled to the head assembly 106 and the head plate 126. The left strap 116 includes a size adjustment mechanism 116*b* for adjusting a length of the strap 116. The left strap 116 is comprised of a suitable material, such as, for example, cloth, flexible metal, plastic, and the like.

Figure 5:
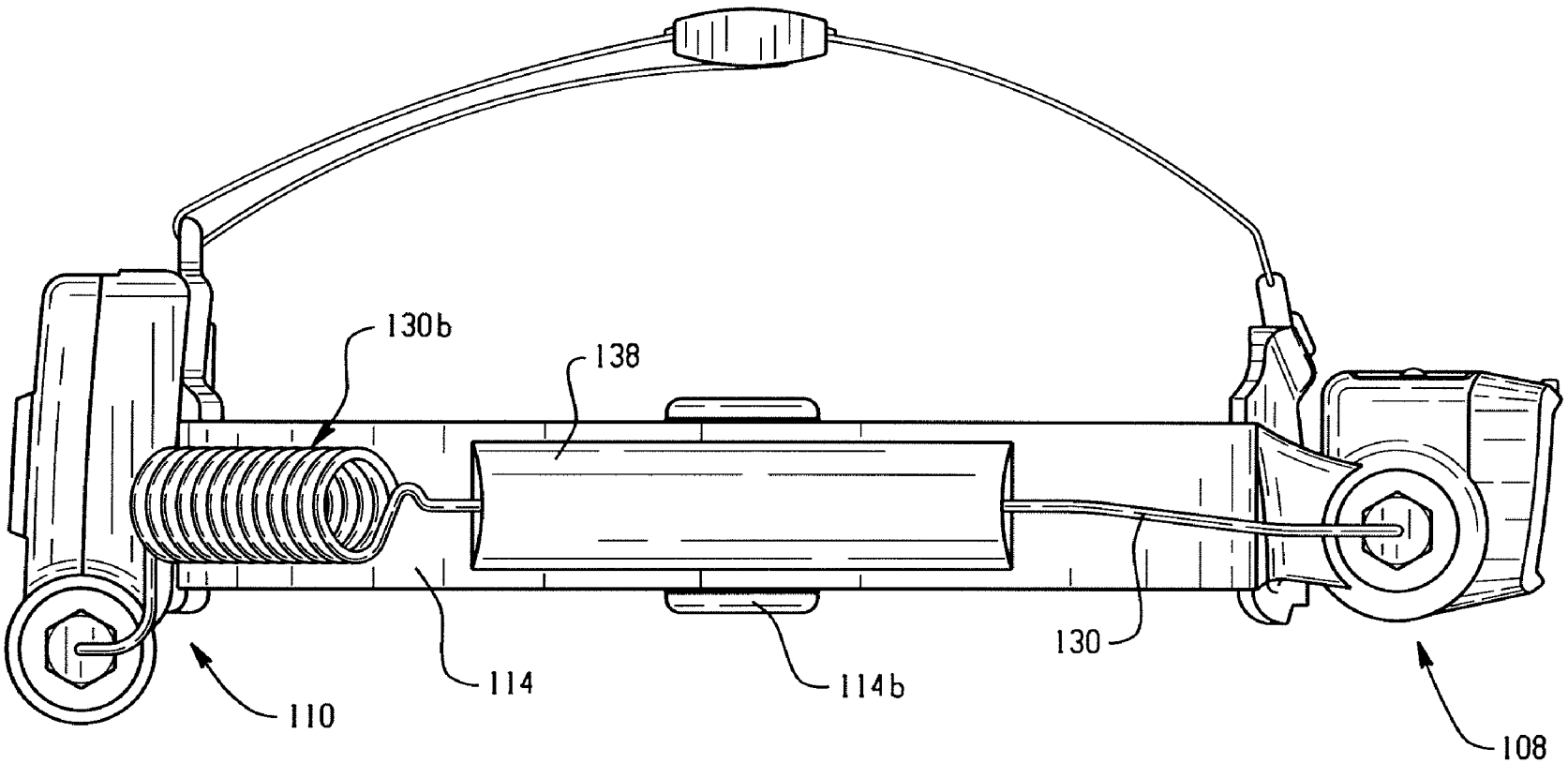
FIG. 5 is a right side view of the lighting device in accordance with an embodiment of the invention.

The right strap 114 is coupled to the head assembly 106 and the head plate 126. The right strap 114 can also include an adjustment mechanism 114*b*, shown in FIG. 5, similar to that employed for the left strap 116. The right strap 114 also includes a conductive cable routing mechanism 138, as shown in FIG. 5, for routing and protecting the conductor wire or cable 130. In one example, the mechanism 138 comprises a protective sleeve affixed to the right strap 114. In another example, the mechanism 138 comprises multiple eyelets and/or straps into and affixed to the strap 114. The right strap 114 is comprised of a suitable material, such as, for example, cloth, flexible metal, plastic, and the like.

It is noted that the conductive wire or cable 130 can comprise multiple conductors for transferring power and/or information. The information can include power requirements, operation modes, remaining batter capacity, and the like.

In an alternate embodiment, the right strap 114 includes conductive thread and/or fibers for transferring power and/or information and at least partially omits the wire 130.

The top strap 118 is coupled to the head assembly 106 via the strap release 112 and the head plate 126. The top strap 118 can also include an adjustment mechanism 118*b* similar to that employed for the left strap 116. The top strap 118 is comprised of a suitable material, such as, for example, cloth, flexible metal, plastic, and the like.

One or more of the straps 114, 116, and 118 may include a material that facilitates gripping the strap 114, 116, and 118. Such a material may be part of the strap and/or be included on a surface of the strap 114, 116, and 118. In one instance, such a material includes a silicon based material or the like. Such a material may help grip a hat or other object placed over the lighting device 100. Such a material may also help a user hold on to the lighting device 100. These examples are provided for explanatory purposes and are not limiting.

Figure 2:
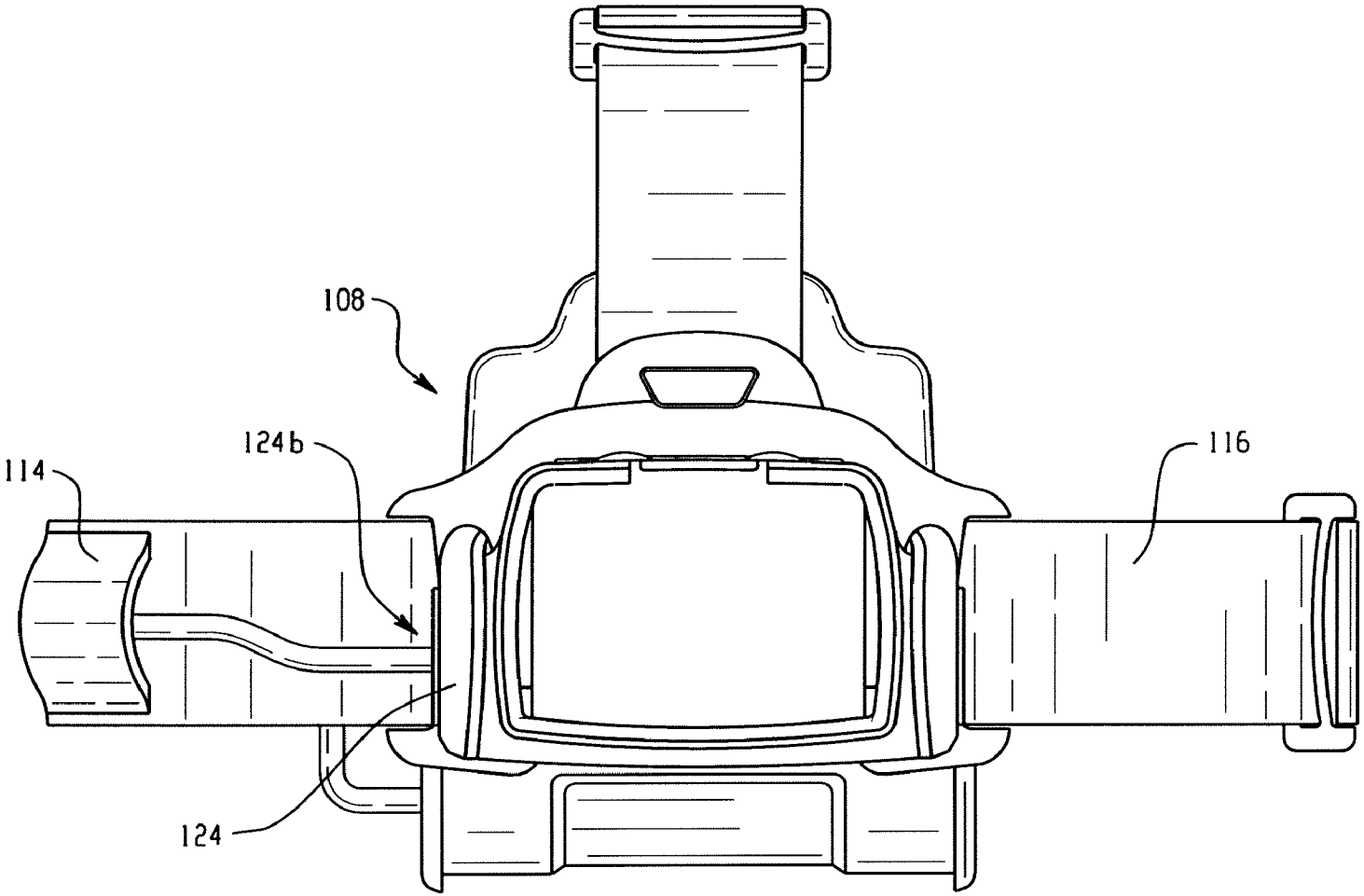
FIG. 2 is a front view of the lighting device in accordance with an embodiment of the invention.

FIG. 2 is a front view of the lighting device 100 in accordance with an embodiment of the invention. The pivot housings 124 are shown as attaching the light housing 108 and the wire entering the light housing 108 via one 124*b* of the pivot housings 124.

Figure 3:
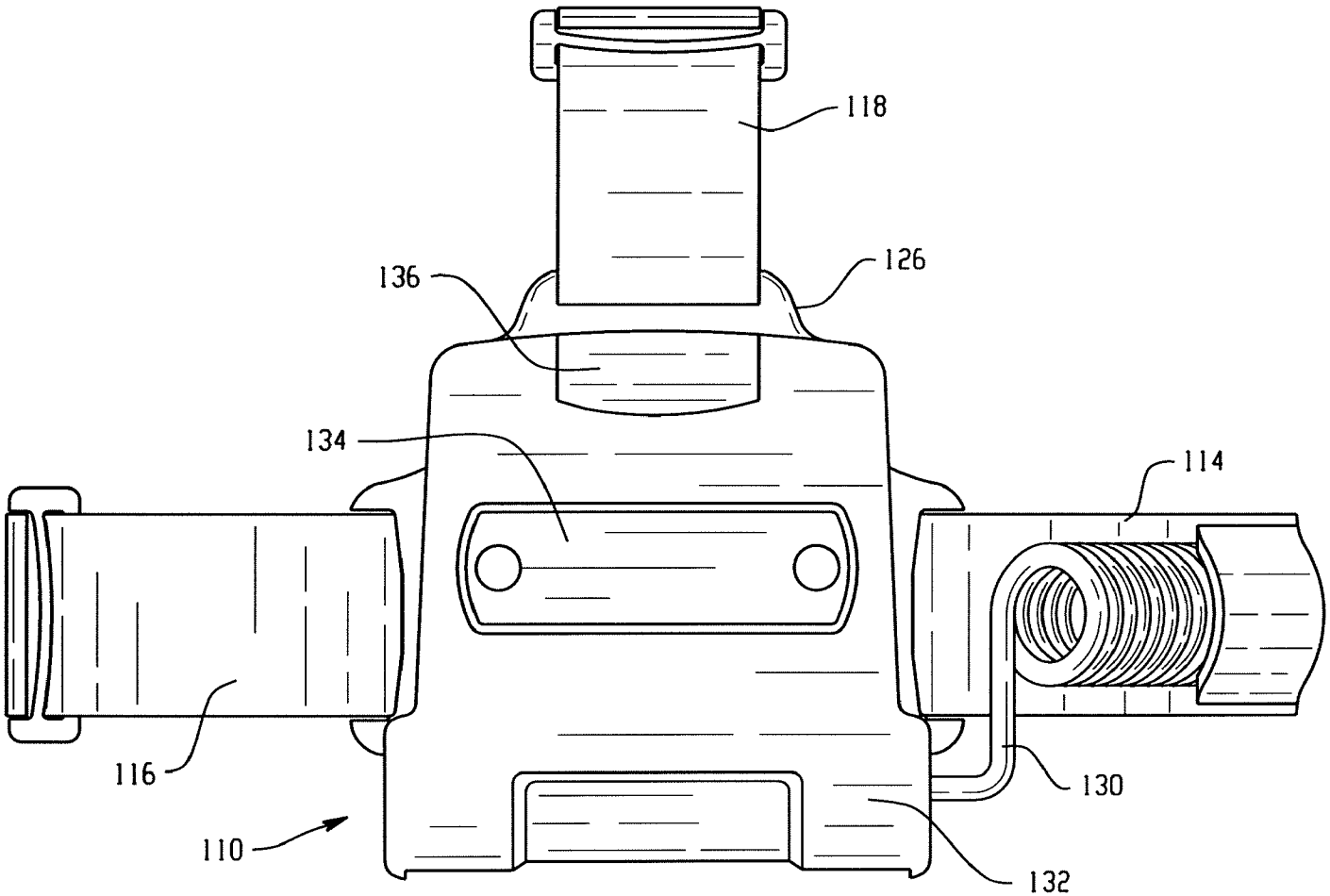
FIG. 3 is a rear view of the lighting device in accordance with an embodiment of the invention.

FIG. 3 is a rear view of the lighting device 100 in accordance with an embodiment of the invention. A plate 134 is affixed to an outward facing portion of the battery pack 110. The plate 134 can include identification information and/or provide additional structural support for the battery pack. In one example, the plate 134 is comprised of metal. A pack attachment mechanism 136 is affixed to the head plate and/or the case 132 and is shown coupled to the top strap 118 to permit attachment and/or removal of top strap to the head plate 126. The wire 130 is shown connected to the battery pack 110 via a grommet, in this example.

Figure 4:
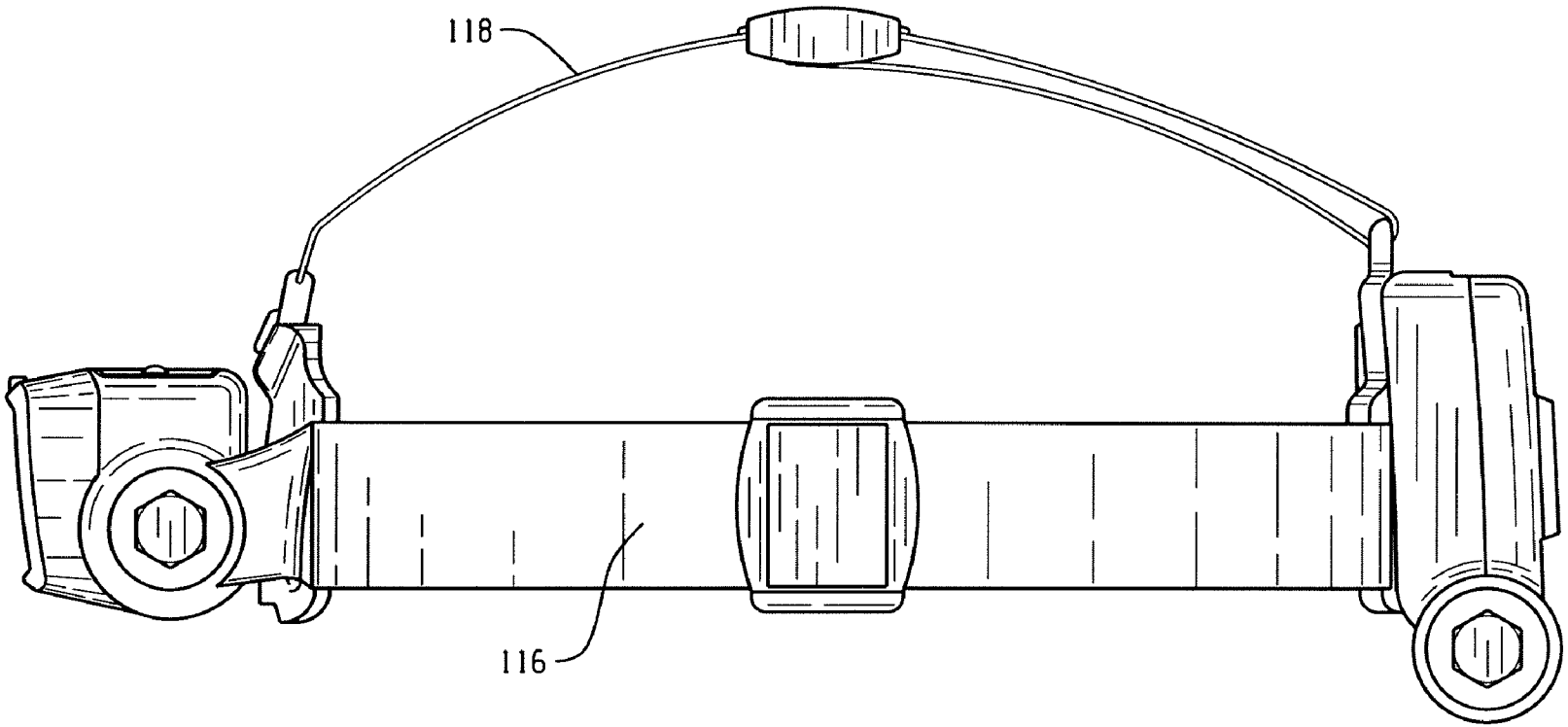
FIG. 4 is a left side view of the lighting device in accordance with an embodiment of the invention.

FIG. 4 is a left side view of the lighting device 100 in accordance with an embodiment of the invention. This view further illustrates the left side strap 116 and the top strap 118.

FIG. 5 is a right side view of the lighting device 100 in accordance with an embodiment of the invention. This view further illustrates the right side strap 114 and the mechanism 138. The wire 130 includes a coiled portion 130*b* that accounts and permits for variations in lengths or distances between the battery pack 110 and the light housing 108.

Figure 6:
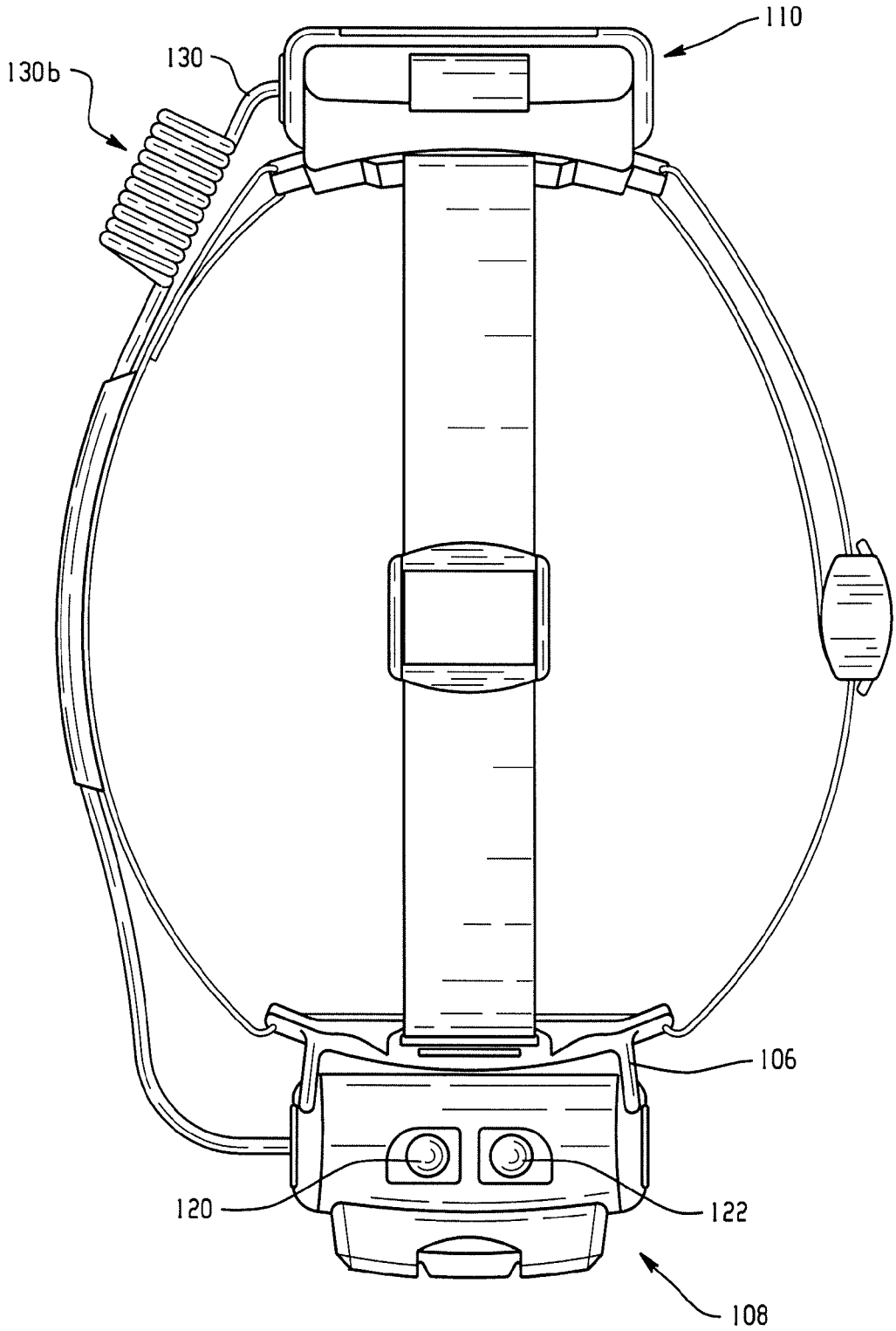
FIG. 6 is a top view of the lighting device in accordance with an embodiment of the invention.

FIG. 6 is a top view of the lighting device 100 in accordance with an embodiment of the invention. The first and second switches 120 and 122 are further illustrated.

Figure 7:
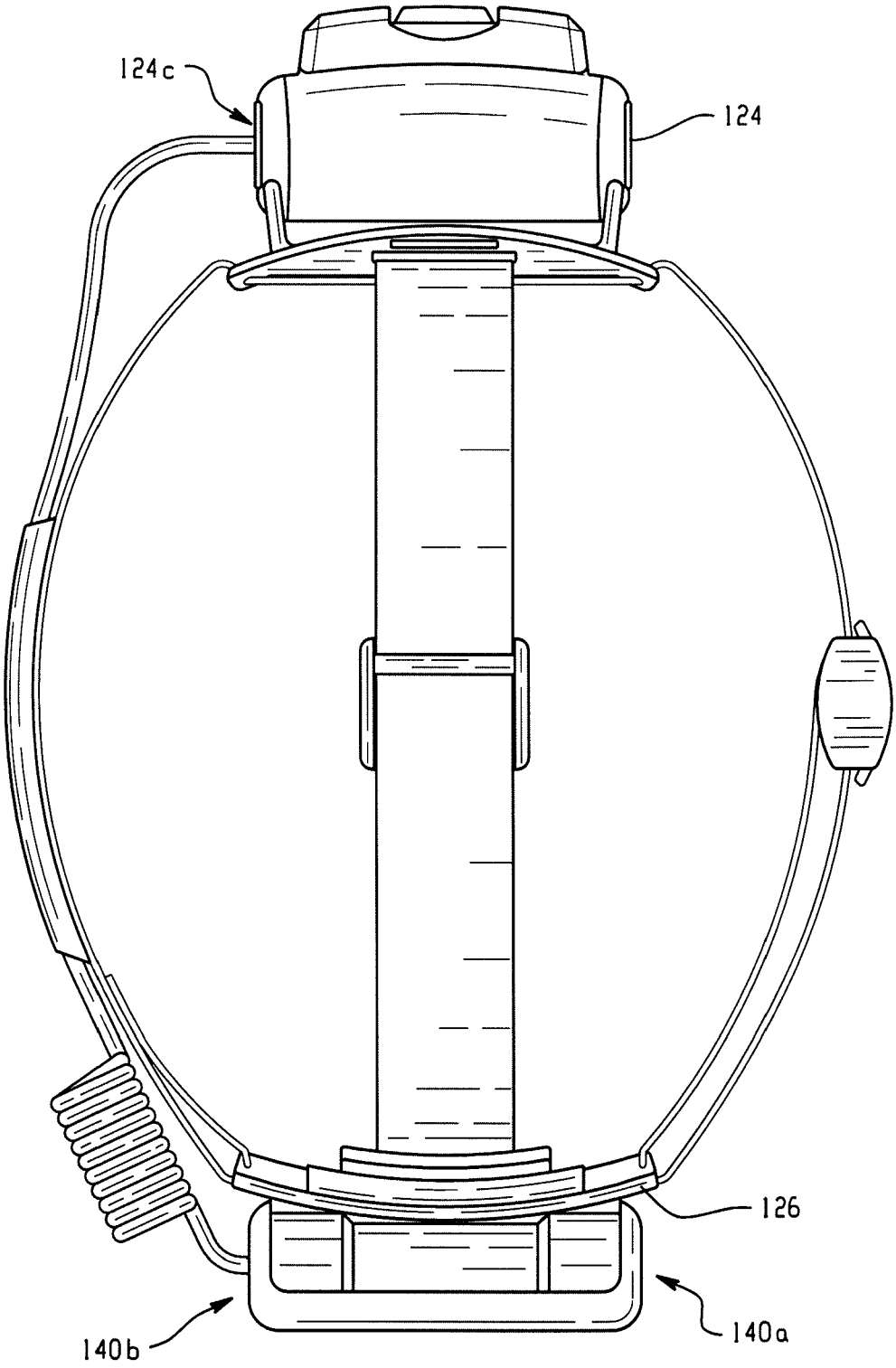
FIG. 7 is a bottom view of the lighting device in accordance with an embodiment of the invention.

FIG. 7 is a bottom view of the lighting device 100 in accordance with an embodiment of the invention. Battery pivot housings 140*a* and 140*b* pivotably affix the case 132 to the head plate 126. The case 132 can be oriented in a variety of positions to facilitate insertion and/or removal of batteries or use of the device.

Figure 8:
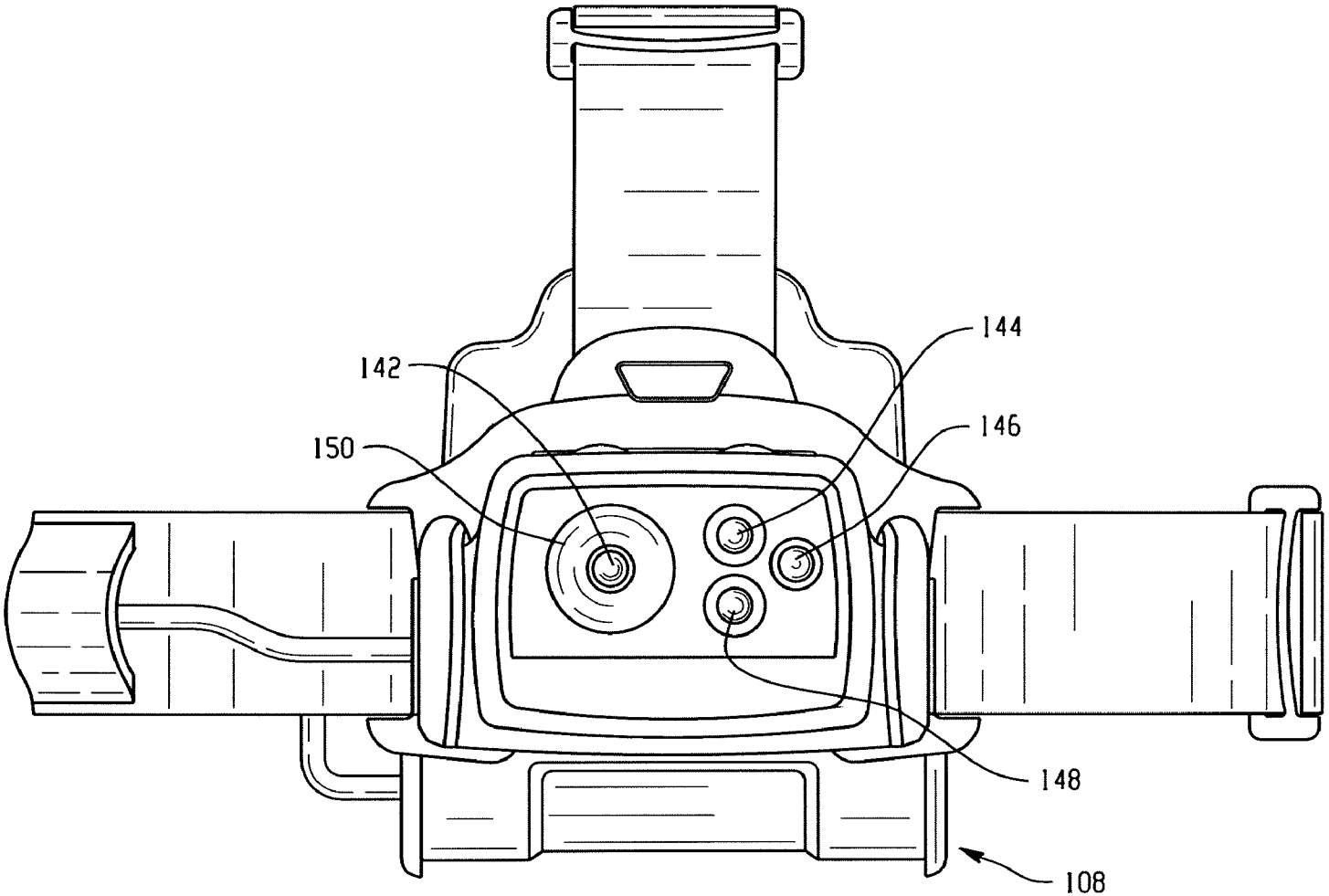
FIG. 8 is a front view of the lighting device in accordance with an embodiment of the invention further illustrating the light housing.

FIG. 8 is a front view of the lighting device 100 in accordance with an embodiment of the invention further illustrating the light housing 108. The one or more housed light sources include, in this example, a white light emitting diode (LED) 142, a first red LED 144, a green LED 146, and a second red LED 148. In this example, the LEDs are 5 mm sized. Reflector(s) 150 are present to facilitate light emission by the light sources. The reflector(s) 150 include parabolic shaped reflectors, aspheric shaped reflectors, and the like. It is noted that alternate aspects of the invention can include other light sources and arrangements of the light sources varied from that shown in FIG. 8.

Figure 9:
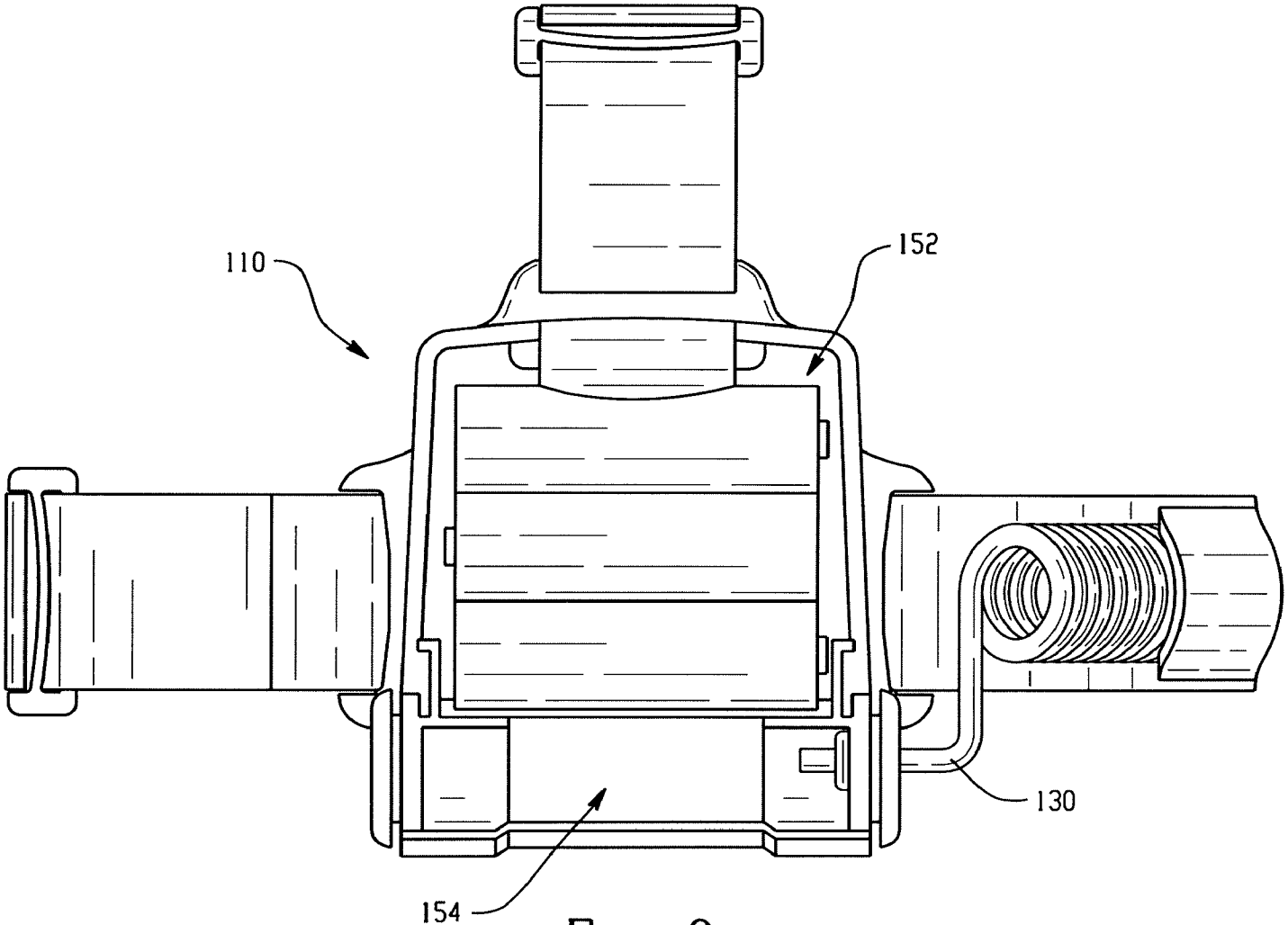
FIG. 9 is another rear view of the lighting device in accordance with an embodiment of the invention.

FIG. 9 is another rear view of the lighting device 100 in accordance with an embodiment of the invention. This view further illustrates an interior of the battery pack 110, which is shown with inserted batteries 152 and a circuit board 154. The inserted batteries 152 include primary and/or secondary types of batteries, such as alkaline, lithium ion, nickel-metal hydride, and the like types of batteries and can be coupled to the wire 130 and/or the circuit board 154 via a connection mechanism or contacts. The circuit board 154 monitors states of the switches 120, 122 and controls modes of operation according to the states. Alternately, the switches themselves 120, 122 can control the modes of operation.

The circuit board 154, in one example, can also monitor battery use and remaining capacity. Further, the circuit board, in one example, can indicate low power remaining, such as by flashing one of the light sources. Additionally, as other examples, the circuit board 154 can automatically turn off the light sources after a period of time, operate in a lower power consumption mode wherein the light sources are pulse width modulated to provide light at a reduced intensity and power consumption. Also, the circuit board 154 can facilitate charging of inserted batteries, temperature monitoring and control, perform power regulation, and the like as other examples.

Other devices (not shown), such as a pencil holder, tool holder, document holder, cell phone, and the like can be removably attached to portions of the device 100, such as the head assembly 106 or the straps 114, 116. For example, a sleeve in the left side strap 116 can permit attachment of a pencil or pen. As another example, a bracket or clip can be attached to the device 100 that holds or supports a level or measuring tape.

FIGS. 1 to 9 are provided for illustrative purposes. It is appreciated that alternate embodiments of the invention include variations and omissions of the device 100.

Figure 10:
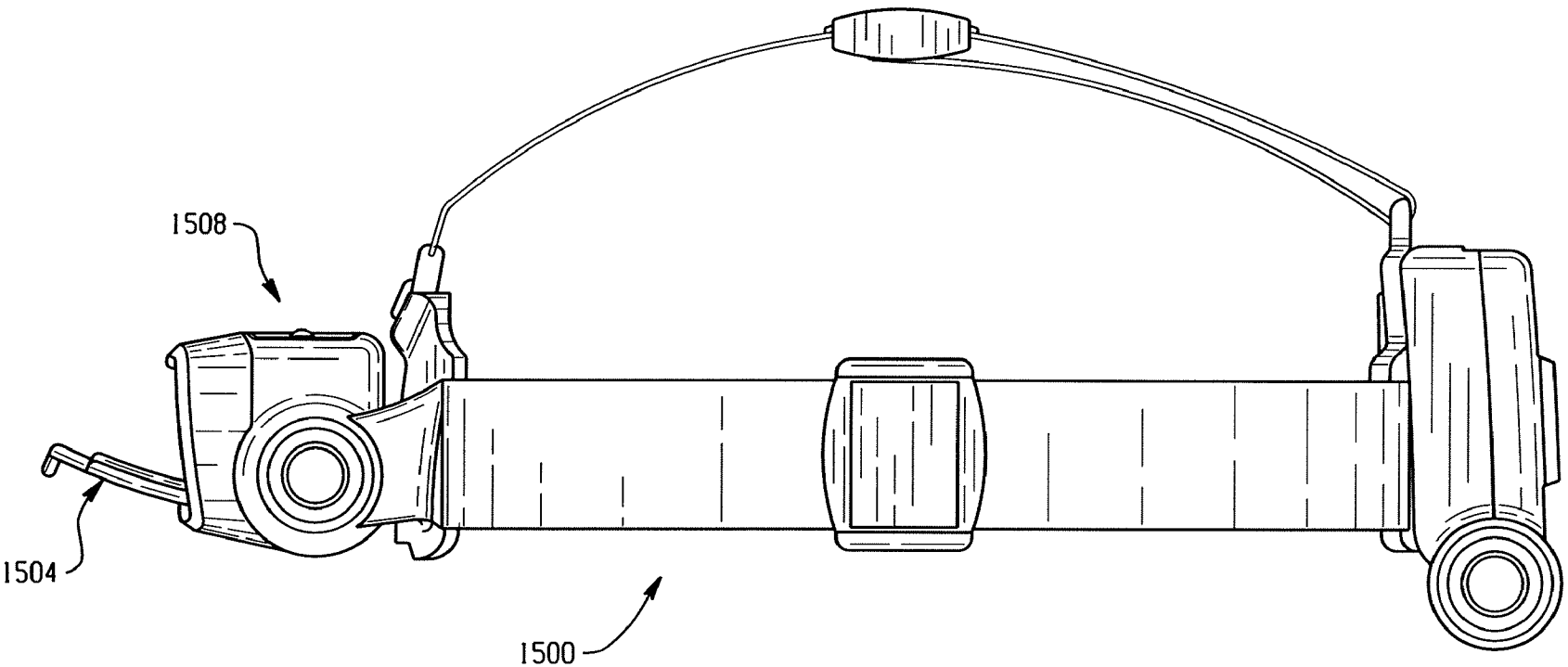
FIG. 10 is another side view of a lighting device in accordance with an embodiment of the invention.

FIG. 10 is a side view of a lighting device 1500 in accordance with an embodiment of the invention. The view is provided for illustrative purposes as an example and is not intended to limit the invention to the particular device shown. For further description of these components, reference similarly named components of the device 100 discussed above.

In this view, a diffusing lens 1504 of a light housing 1508 is shown in a partially retracted position.

Figure 11:
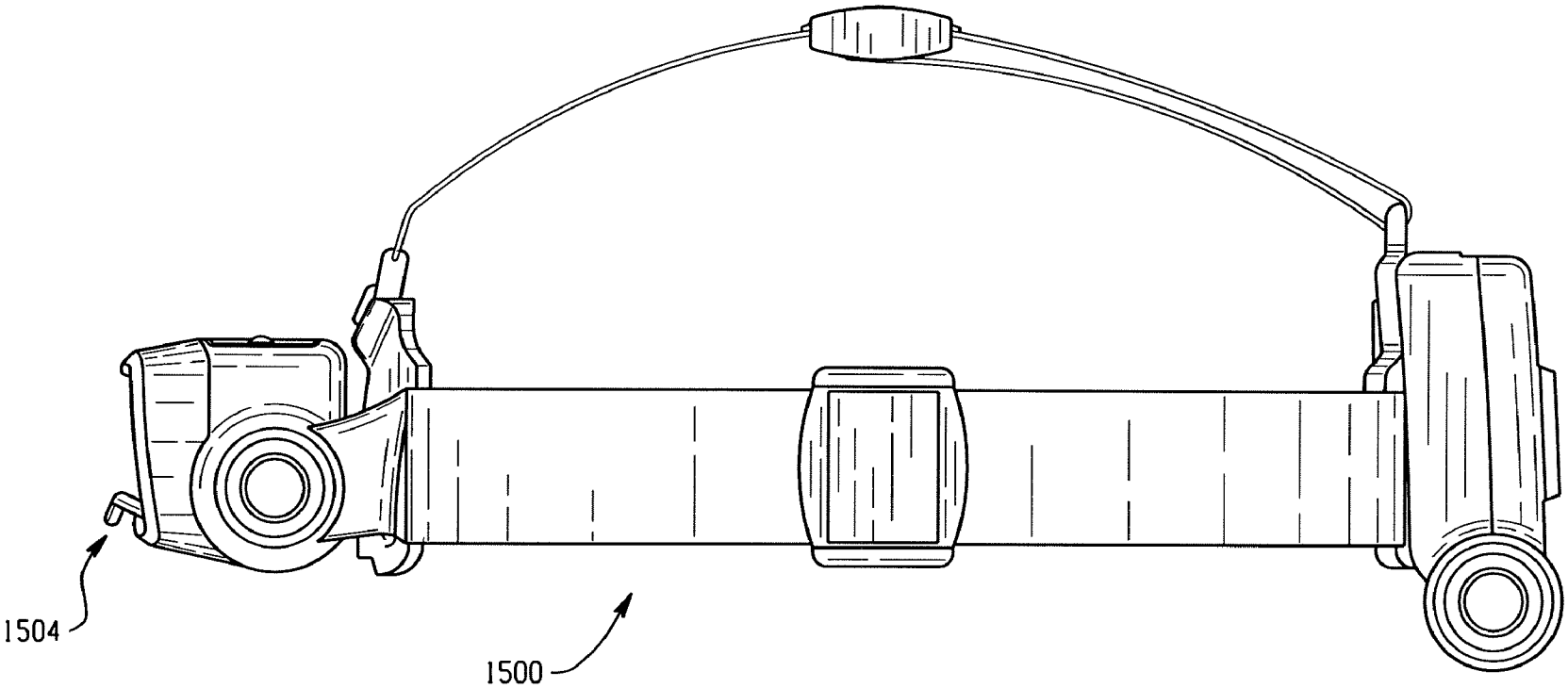
FIG. 11 is another side view of the lighting device in accordance with an embodiment of the invention.

FIG. 11 is another side view of the lighting device 1500 in accordance with an embodiment of the invention. The view is provided for illustrative purposes as an example and is not intended to limit the invention to the particular device shown.

In this view, the diffusing lens 1504 of the light housing 1508 is shown in a retracted position.

The following paragraphs are considered examples and part of the specification:

1. A lighting device, comprising:
a head assembly;
a battery pack operatively coupled to a first end of the head assembly; and
a light housing operatively coupled to a second end of the head assembly, the light housing, including:
at least one light source; and
a diffuser lens pivotably and retractably coupled to the light housing, wherein the diffuser lens is configured to pivot between a first position in which the diffuser lens diffuses light emitted by the at least one light source and a second position in which a substantial amount of the light emitted by the at least one light source is not diffused by the diffuser lens, and wherein the diffuser lens is positionable in a retracted position.

18. The lighting device of 1, wherein the head assembly includes:
a left strap;
a right strap; and
a top strap.

23. The lighting device of 18 or 20, wherein at least one of the straps (114, 116, 118) includes a sleeve through which the conductor wire (130) extends.

24. The lighting device of 18, 20 or 23, further including a sleeve affixed to at least one of the straps (114, 116, 118), wherein the conductor wire (130) is routed through the sleeve.

25. The lighting device of 18,wherein at least one of the straps (114, 116, 118) includes a size adjustment mechanism (116*b*) for adjusting a length of the strap (114, 116, 118).

26. The lighting device of 1, 2, 3, 4, 5, 6, 9, 14, 16 or 18, wherein the battery pack (110) includes a circuit board (154).

27. The lighting device of 26, wherein the circuit board (154) monitors a state of the switches (120, 122).

28. The lighting device of 26 or 27, wherein the circuit board (154) controls modes of operation of the device (100).

29. The lighting device of 26, 27 or 28,wherein the circuit board (154) monitors battery use and remaining capacity.

30. The lighting device of 26, 27, 28 or 29, wherein the circuit board (154) indicates low power remaining by flashing one of the at least one light sources (142, 144, 146, 148).

31. The lighting device of 26, 27, 28, 29 or 30, wherein the circuit board (154) automatically turns off the at least one light source (142, 144, 146, 148) after a pre-set period of time.

32. The lighting device of 26, 27, 28, 29, 30 or 31, wherein the circuit board (154) operates the at least one light source (142, 144, 146, 148) in a lower power consumption mode wherein the at least one light source (142, 144, 146, 148) is pulse width modulated to provide light at a reduced intensity and power consumption.

33. The lighting device of 26, 27, 28, 29, 30 or 31, wherein the circuit board (154) facilitates at least one of charging at least one battery inserted in the battery pack (110), monitoring temperature, and performing power regulation.

34. The lighting device of 1, 2, 3, 4, 5, 6, 9, 14, 16, 18, or 26, wherein the battery pack (110) is hermetically sealed.

35. The lighting device of 34,wherein the hermetic sealed substantially prevents external gases from entering the pack (110).

36. The lighting device of 1 or 18,further including a fastening device for removeably attaching at least one of a pencil holder, a tool holder, a document holder, or a cell phone to the device (100).

37. A method for selectively diffusing light emitted from at least one light source (142, 144, 146, 148) in a light housing (108) of a human wearable headlight (100) via a diffuser lens (104), comprising:
selectively pivoting the diffuser lens (104), which is pivotably coupled to the light housing (108), to one of a plurality of different positions in which the diffuser lens (104) diffuses the light emitted by the at least one light source (142, 144, 146, 148) based on the position of the diffuser lens (104).

38. The method of 37, wherein the diffuser lens (104) diffuses the emitted light to a different degree at each of the plurality of different positions.

39. The method of 37, further including:
employing a first switch of the headlight to operate a first light of the at least one light source (142, 144, 146, 148) based on one of a plurality of first modes; and
employing a second switch of the headlight to operate a second light of the at least one light source (142, 144, 146, 148) based on one of a plurality of second modes.

40. The method of 39, wherein the plurality of first modes includes a high intensity mode, a low intensity mode, and an off mode, and the plurality of second modes includes a first red light mode, a second red light mode, a green light mode, and an off mode.

41. The method of 37 or 39, further including pivoting the light housing (108) about at least one pivot (124) to direct the light emitted by the at least one light source (142, 144, 146, 148).

42. The method of 37, 39 or 41, further including routing a conductive wire supplying power to the at least one light source (142, 144, 146, 148) through a head strap (114, 116, 118) of the headlight (100).

43. The method of 37, 39, 41 or 42, further including releasably affixing at least one head of the headlight (100).

44. The method of 42 or 43, wherein at least one of the straps (114, 116, 118) includes a gripping material on its surface.

The above numbered paragraphs are considered part of the specification.

Although the invention has been shown and described with respect to a certain aspect or various aspects, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several aspects of the invention, such feature may be combined with one or more other features of the other aspects as may be desired and advantageous for any given or particular application. Also, the term "exemplary" is intended as an example, not as a best or superior solution. Furthermore, to the extent that the term "includes" is used in either the detailed description or the claims, such term is intended to be inclusive in a manner similar to the term "comprising."

What is claimed is:

1. A lighting device, comprising:

a head assembly;

a battery pack operatively coupled to a first end of the head assembly; and a light housing operatively coupled to a second end of the head assembly, the light housing, including;

at least one light source; and a diffuser lens coupled to the light housing, the diffuser lens pivots between a first position and a second position and the diffuser lens retracts to a retracted position.

2. The lighting device of claim 1, wherein the diffuser lens is configured to pivot to at least one position between the first and second positions, wherein the diffuser lens, when at the least one position between the first and second positions, partially diffuses the light emitted by the at least one light source.

3. The lighting device of claim 2, wherein the diffuser lens, when in the at least one position between the first and second positions, diffuses less of the light emitted by the at least one light source relative to when the diffuser lens is in the first position and more of the light emitted by the at least one light source relative to when the diffuser lens is in the second position.

4. The lighting device of claim 3, wherein the diffuser lens is positionable throughout a range of positions between the first and second positions, thereby providing a range of degrees of diffusion.

5. The lighting device of claims 1, wherein the diffuser lens includes a translucent material that diffuses light passing there through.

6. The lighting device of claims 1 wherein the light housing includes a first mode switch, which operates a first light source of the at least one light sources.

7. The lighting device of claim 6, wherein the first mode switch selects one or more first modes of operation.

8. The lighting device of claim 7, wherein the one or more first modes of operation includes a high intensity mode, a low intensity mode, and an off mode.

9. The lighting device of claims 1, wherein the light housing includes a second mode switch, which operates a second light source of the at least one light sources.

10. The lighting device of claim 9, wherein the second mode switch selects one or more second modes of operation.

11. The lighting device of claim 10, wherein the one or more second modes of operation includes a first red light mode, a second red light mode, a green light mode, and an off mode.

12. The lighting device of claims 9, wherein the one or more first modes of operation are different from the one or more second modes of operation.

13. The lighting device of claim 1, wherein the at least one light source is a 5 mm LED.

14. The lighting device of claim 1, wherein the light housing is attached to the head assembly by at least one pivot, wherein the light housing is configured to move about the at least one pivot between at least a first position in which the light emitted by the at least one light source is directed in a first direction and a second position in which the light emitted by the at least one light source is directed in a second different direction.

15. The lighting device of claim 14, wherein the at least one pivot include a mechanism that holds the light housing in the first or second position.

16. The lighting device of claims 1, further including a conductor wire that extends from the battery pack to the at least one light source, wherein the conductor wire is in electrical communication with both a battery in the battery pack and the at least one light source, and the battery supplies power to the at least one light source via the conductor wire.

17. The lighting device of claim 16, wherein the conductive wire includes multiple conductors for transferring at least one of power or information, including at least one of power requirements, operation modes, or remaining batter capacity.

18. The lighting device of claim 1, wherein the head assembly includes:

a left strap;

a right strap; and a top strap.

19. The lighting device of claim 18, wherein the straps are arranged to conform to a shape of a human head.

20. The lighting device of claim 18, wherein at least one of the straps includes a gripping material comprised of silicon.

21. The lighting device of claim 1, the diffuser lens retracts to the retracted position only from the second position.

* * * * *